US009010480B2

(12) United States Patent
Sakai et al.

(10) Patent No.: US 9,010,480 B2
(45) Date of Patent: Apr. 21, 2015

(54) BULLDOZER

(71) Applicant: Komatsu Ltd., Minato-ku, Tokyo (JP)

(72) Inventors: Kiyotaka Sakai, Komatsu (JP); Taisuke Mizuno, Hakusan (JP); Hirokazu Asaka, Kaga (JP)

(73) Assignee: Komatsu Ltd., Tokyo (JP)

( * ) Notice: Subject to any disclaimer, the term of this patent is extended or adjusted under 35 U.S.C. 154(b) by 133 days.

(21) Appl. No.: 13/713,853

(22) Filed: Dec. 13, 2012

(65) Prior Publication Data

US 2013/0277135 A1 Oct. 24, 2013

(30) Foreign Application Priority Data

Apr. 24, 2012 (JP) ..... 2012-098567

(51) Int. Cl.

| | |
|---|---|
| ***E02F 9/08*** | (2006.01) |
| ***E02F 3/84*** | (2006.01) |
| ***E02F 3/76*** | (2006.01) |
| ***E02F 3/80*** | (2006.01) |

(52) U.S. Cl.

CPC ..... *E02F 9/0866* (2013.01); *E02F 3/7609* (2013.01); *E02F 3/84* (2013.01); *E02F 3/80* (2013.01); *E02F 9/0891* (2013.01)

(58) Field of Classification Search

CPC ..... B60K 13/04; B60K 11/04; B60K 5/04; B60K 11/06; B60K 5/00; B60K 11/00; B60K 5/02; B62K 5/01; F01N 2340/04; F01N 13/08; F01N 13/1805; F01N 2590/08; F01P 11/10; F01P 2001/005

USPC ..... 180/309, 68.1, 68.2, 68.3, 89.12, 89.2

See application file for complete search history.

(56) References Cited

U.S. PATENT DOCUMENTS

| | | | | | |
|---|---|---|---|---|---|
| 1,513,036 | A | * | 10/1924 | Donaldson | 55/330 |
| 3,630,003 | A | * | 12/1971 | Ashton et al. | 56/14.7 |
| 3,786,891 | A | * | 1/1974 | Vogelaar et al. | 180/68.4 |
| 4,454,926 | A | * | 6/1984 | Akins | 180/68.1 |

(Continued)

FOREIGN PATENT DOCUMENTS

| | | | |
|---|---|---|---|
| JP | 4-292522 | A | 10/1992 |
| JP | 2009-507144 | A | 4/2001 |

(Continued)

*Primary Examiner* — J. Allen Shriver, II
*Assistant Examiner* — Bridget Avery
(74) *Attorney, Agent, or Firm* — Global IP Counselors, LLP

(57) ABSTRACT

A bulldozer is equipped with a cab, a cooling device, an engine cover, an engine, and an exhaust emission control device. The cooling device is situated behind the cab. The engine cover is situated in front of the cab. The engine is situated inside the engine cover. The engine includes a crank shaft that extends in the longitudinal direction of the bulldozer. The exhaust emission control device includes a main body pipe part and a connecting pipe part connecting to the main body pipe part. The exhaust emission control device cleans the exhaust from the engine inside the main body pipe part. The main body pipe part is situated in the front of the engine. At least a portion of the main body pipe part is situated to overlap with the engine in the front view of the bulldozer.

14 Claims, 9 Drawing Sheets

(56) References Cited

U.S. PATENT DOCUMENTS

| | | | | |
|---|---|---|---|---|
| 5,228,530 | A * | 7/1993 | Tsuchihashi | 180/68.4 |
| 6,022,254 | A * | 2/2000 | Neisen | 440/89 R |
| 7,475,750 | B2 * | 1/2009 | Tokuhara | 180/69.2 |
| 7,717,205 | B2 * | 5/2010 | Kertz et al. | 180/68.3 |
| 7,753,152 | B2 | 7/2010 | Nakae et al. | |
| 8,167,067 | B2 * | 5/2012 | Peterson et al. | 180/68.2 |
| 2002/0017408 | A1 * | 2/2002 | Oshikawa et al. | 180/69.2 |
| 2005/0077062 | A1 * | 4/2005 | Fukazawa et al. | 172/776 |
| 2007/0056786 | A1 * | 3/2007 | Fukazawa et al. | 180/89.12 |
| 2009/0188389 | A1 | 7/2009 | Dacosta et al. | |

FOREIGN PATENT DOCUMENTS

| | | | | | |
|---|---|---|---|---|---|
| JP | 2005-29152 | A | | 2/2005 | |
| JP | 2009-507145 | A | | 2/2009 | |
| JP | 2009-138526 | A | | 6/2009 | |
| JP | 2010-83331 | A | | 4/2010 | |
| JP | 2012-30736 | A | | 2/2012 | |
| JP | 2012136845 | A | * | 7/2012 | E02F 9/00 |

* cited by examiner

BULLDOZER

CROSS-REFERENCE TO RELATED APPLICATIONS

This application claims priority under 35 U.S.C. §119 to Japanese Patent Application No. 2012-098567, filed on Apr. 24, 2012. The entire disclosure of Japanese Patent Application No. 2012-098567 is hereby incorporated herein by reference.

BACKGROUND

1. Field of the Invention

The present invention relates to a bulldozer.

2. Background Information

Due to recent environment protection measures, bulldozers are equipped with a powerful device for exhaust emission control. The exhaust emission control device is an apparatus that cleans the exhaust from the engine, and includes, for example, diesel particulate filters. The exhaust emission control device is connected to the engine so it is desirable to be positioned adjacent to the engine. For example, US Patent Application Publication No. US2009/0188389 discloses a bulldozer equipped with a diesel particulate filter on the engine.

SUMMARY

Normally, engines are supported by a mounting part. As indicated in the abovementioned bulldozer, an exhaust emission control device such as a diesel particulate filter is mounted on the engine to increase the distance between the mounting part and the exhaust emission control device. As the distance between the mounting part and the exhaust emission control device increases, the amount of displacement of the exhaust emission control device increases when the engine vibrates in any direction. As a result, the acceleration and vibration applied to the exhaust emission control device increases, and the additional load on the exhaust emission control device is a concern.

On the other hand, bulldozers have a cab and engine cover. The engine is situated inside the engine cover. The engine cover is situated in front of the cab. However, with bulldozers, to maintain visibility from the cab to the front, it is preferred that the engine cover is small. In particular, as the height of the engine cover increases, it is possible that the visibility from the cab is reduced by the engine cover. As a result, it is difficult to retain a large space in front of the engine inside the engine cover without restricting the visibility from the cab. In the abovementioned bulldozer, the exhaust emission control device is situated above the engine, and the reduced visibility is a concern.

An object of the present invention is to provide a bulldozer capable of improving the visibility from the cab as well as reducing the load on the exhaust emission control device.

In one embodiment of the present invention, the bulldozer is equipped with a cab, a cooling device, an engine cover, an engine, and an exhaust emission control device. The cooling device is situated behind the cab. The engine cover is situated in front of the cab. The engine is situated inside the engine cover. The engine includes a crank shaft that extends in the longitudinal direction of the bulldozer. The exhaust emission control device includes a main body pipe part and a connecting pipe part connecting to the main body pipe part. The exhaust emission control device cleans the exhaust from the engine inside the main body pipe part. The main body pipe part is situated in the front of the engine. At least a portion of the main body pipe part is situated to overlap with the engine in the front view of the bulldozer.

In one embodiment of the present invention, the main body pipe part of the exhaust emission control device is situated in front of the engine, and at least a portion of the main body pipe part is situated to overlap with the engine in the front view of the bulldozer. As a result, the amplitude of the engine vibration from the main body pipe part is reduced. Therefore, it is possible to lower the toad on the exhaust emission control device. Additionally, since the position on the top surface of the engine cover can be lowered, it is possible to improve the visibility from the cab.

DETAILED DESCRIPTION OF THE EMBODIMENTS

Figure 1:
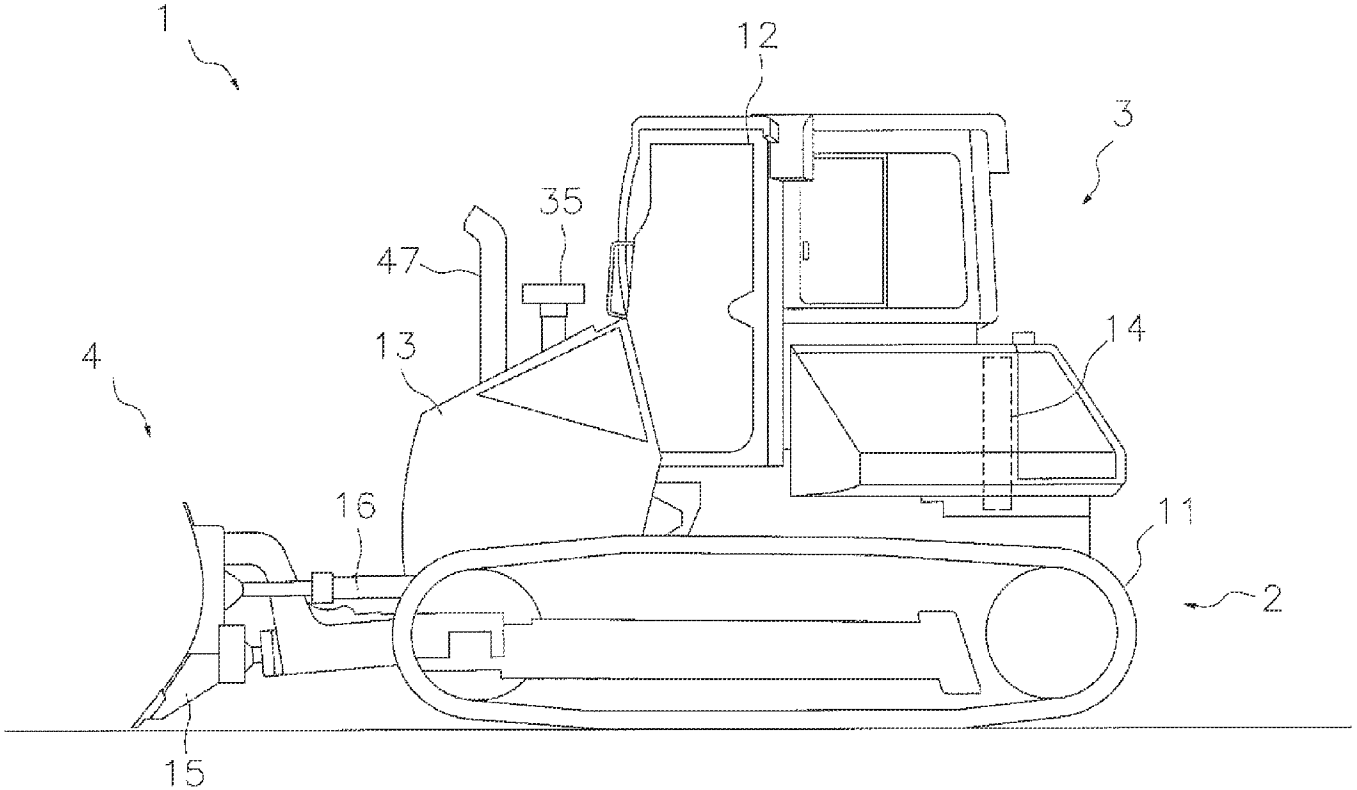
FIG. 1 is a side view of a bulldozer relating to an embodiment of the present invention.

The side view of bulldozer 1 relating to the embodiment of the present invention is shown in FIG. 1. This bulldozer 1 is equipped with a traveling device 2, a vehicle body 3 and a work implement 4. The traveling device 2 is a device that runs the bulldozer and has crawler belts 11. The bulldozer 1 runs when the crawler belts 11 are driven.

The vehicle body 3 includes a body frame 10 (refer to FIG. 2 and FIG. 5), a cab 12, an engine cover 13 and a cooling device 14. The engine cover 13 is situated in front of the cab 12. An engine 5 described later is in the engine cover 13. The top surface of the engine cover 13 is inclined towards the front and downward. The cooling device 14 is situated behind the cab 12. In general, cooling devices are situated in front of the engine inside the engine cover in front of cabs in bulldozers. The cooling device 14 includes, for example, a radiator to cool a cooling fluid of the engine 5 and an oil cooler to cool an operating fluid.

The work implement 4 is disposed in front of the engine cover 13. The work implement 4 has a blade 15 and hydraulic cylinders 16. The blade 15 is installed to pivot vertically. The hydraulic cylinders 16 change the position of the blade 15.

Figure 2:
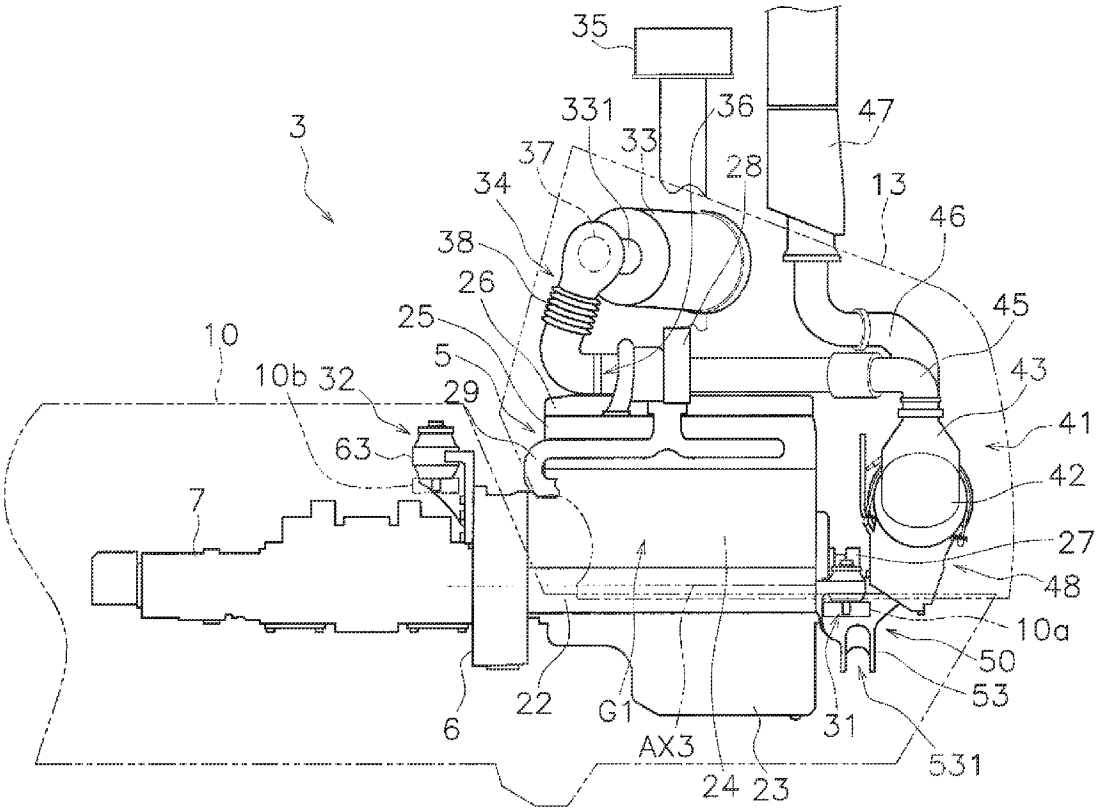
FIG. 2 is a side view showing the configuration inside an engine cover of the bulldozer.
Figure 3:
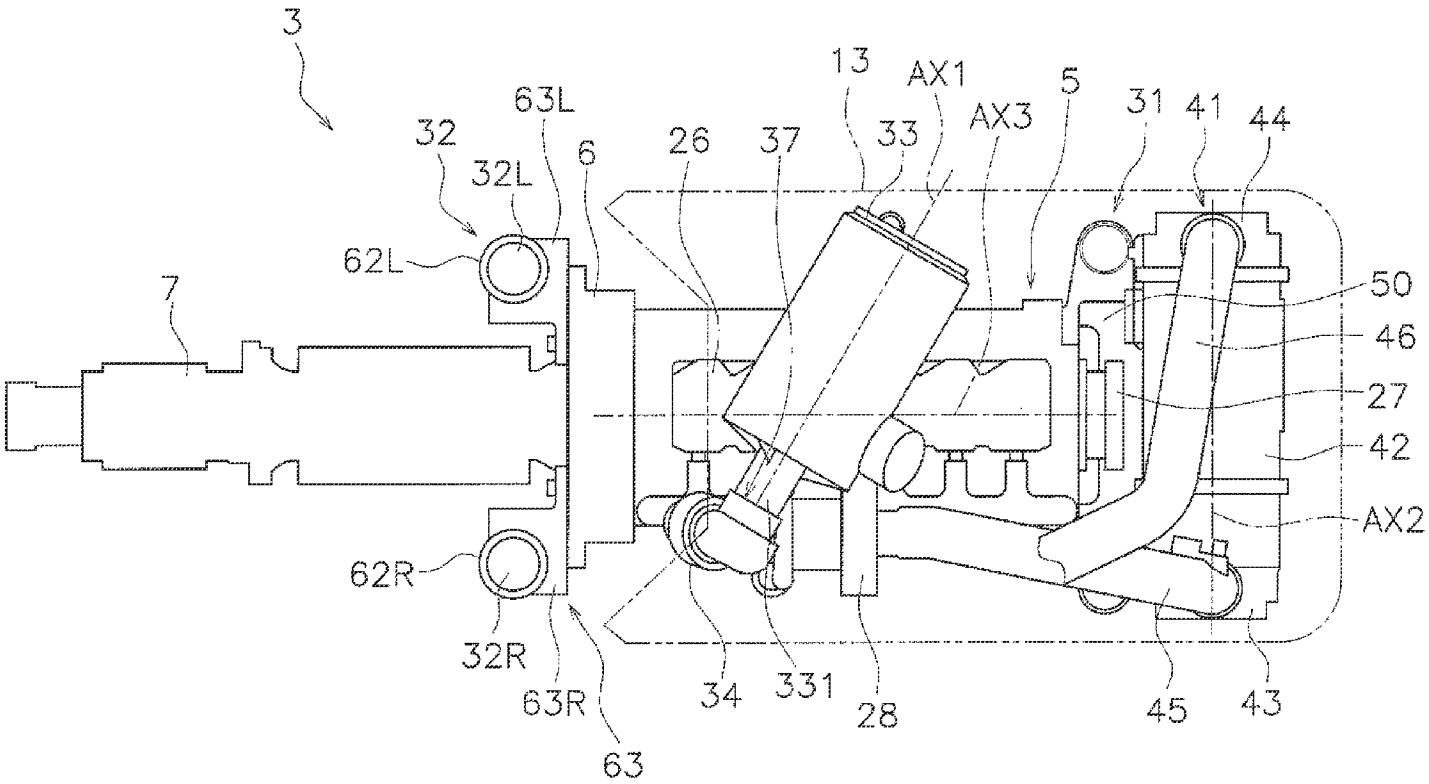
FIG. 3 is a plane view showing the configuration inside the engine cover.
Figure 4:
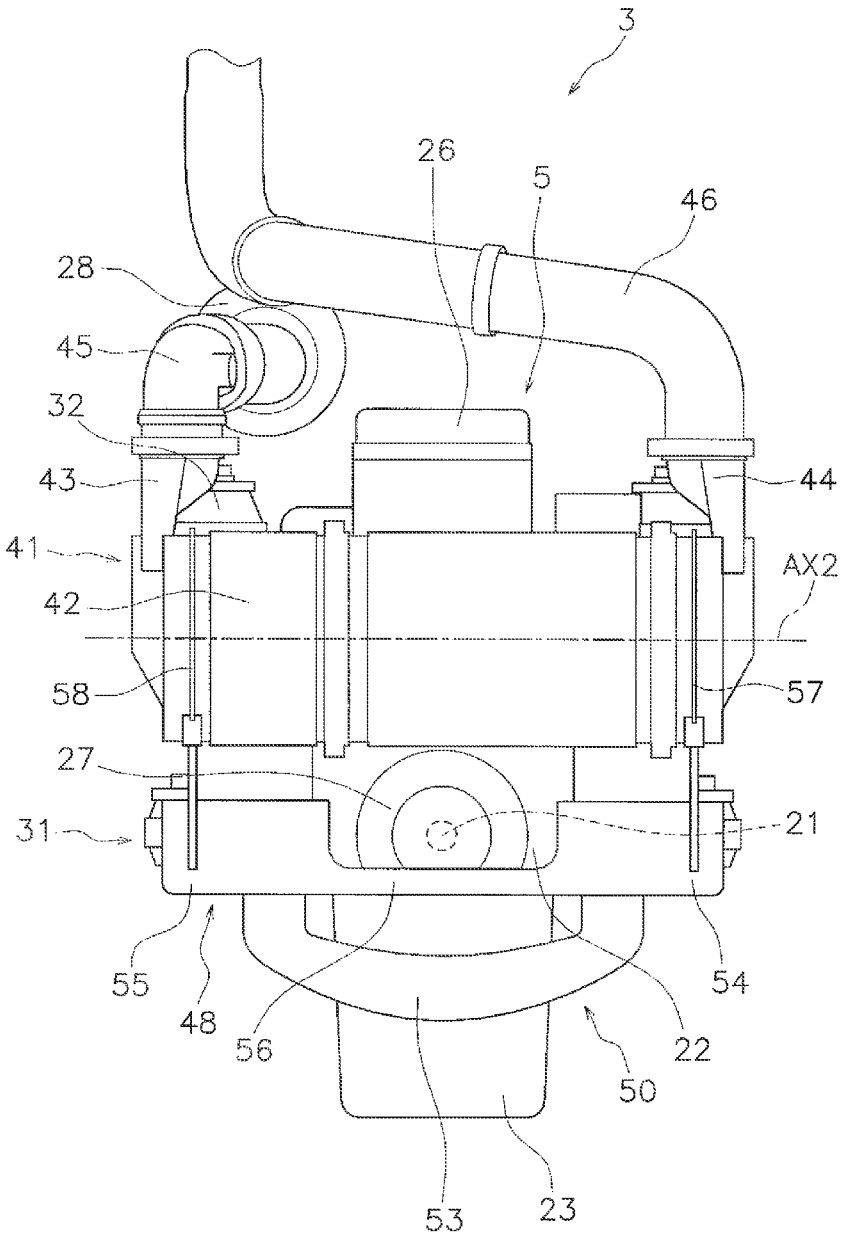
FIG. 4 is a front view showing the configuration inside the engine cover.

FIG. 2 is a side view showing the configuration inside the engine cover. In FIG. 2, the right side shows the front of the bulldozer 1. FIG. 3 is a plane view showing the configuration inside the engine cover 13. FIG. 4 is a front view showing the configuration inside the engine cover 13. For easier understanding, the engine cover 13 is omitted in FIG. 4. Furthermore, in FIGS. 2 to 4, a part of the configuration in the engine cover 13 is omitted. As shown in FIGS. 2 to 4, the vehicle body 3 includes the engine 5, a flywheel housing 6 and a hydraulic pump 7. The engine 5, the flywheel housing 6 and the hydraulic pump 7 are situated inside the engine cover 13.

The engine 5 is, for example a diesel engine, where the output of the engine 5 is controlled by regulating the amount of fuel injected from the fuel injector pump (not shown in the figures). Regulation of the fuel injection amount is conducted by a governor not shown in the figures. An all speed control type governor is used as the governor, where the governor regulates the engine rotation speed and the fuel injection amount according to the load so the actual engine rotation speed reaches the set engine rotation speed command value. Thus, the governor adjusts the amount of fuel injection to reduce the differential between the engine rotation speed command value and the actual engine rotation speed.

The engine 5 includes a crank ease 22, an oil pan 23, a cylinder body 24, a cylinder head 25 and a cylinder head cover 26. Also, as shown in FIG. 4, the engine 5 includes a crank shaft 21. The crank shaft 21 extends in the longitudinal direction of the bulldozer 1. In other words, the engine 5 is a so-called longitudinal engine, situated with the long side in the longitudinal direction of the bulldozer 1 and the short side in the direction of the width of the bulldozer 1. Situated in this manner enables the width of the bulldozer to be reduced, which allows visibility to the left and right lower ends of the blade 15 that is required for bulldozers. In FIG. 2, Ax3 shows the line for the central axis of the crank shaft 21. The crank case 22 houses the crank shaft 21. A cam pulley 27 is situated in front of the crank case 22. The crank shaft 21 is connected to the cam pulley 27. The oil pan 23 is situated under the crank case 22. The cylinder body 24 is situated on the crank case 22. The cylinder body 24 and the crank case 22 are integrally formed as a unit. The cylinder head 25 is situated on the cylinder body 24. The cylinder head cover 26 is situated on the cylinder head 25.

Additionally, the engine 5 includes a supercharger 28. The supercharger 28 is connected to the cylinder head 25 with the exhaust pipe 29 of the engine 5. In the plane view of the bulldozer 1, the supercharger 28 is situated to the side of the cylinder head 25. In the side view of the bulldozer 1, at least one part of the supercharger 28 is situated higher than the top surface of the engine 5, specifically, the top surface of the cylinder head cover 26.

The flywheel housing 6 is situated behind the engine 5. The hydraulic pump 7 is situated behind the flywheel housing 6 and attached to the flywheel housing 6. The hydraulic pump 7 is connected to the output shaft of the engine 5 via the flywheel housing 6. The hydraulic pump 7 pumps operating oil driven by the drive force from the engine 5.

Additionally, the vehicle body 3 includes a front mounting part 31 and a rear mounting part 32. The front mounting part 31 and the rear mounting part 32 are situated inside the engine cover 13. The front mounting part 31 and the rear mounting part 32 support the engine 5 on the body frame 10. The front mounting part 31 is supported by a front mount support part 10*a* of the body frame 10. The rear mounting part 32 is supported by a rear mount support part 10*b* of the body frame 10. The rear mounting part 32 is situated rearward of the front mounting part 31. The front mounting part and the back mounting part 32 are discussed in detail later.

The vehicle body 3 includes an air cleaner 33 and a duct 34. The air cleaner 33 and the duct 34 are situated inside the engine cover 13. The air cleaner 33 is situated above the engine 5. The air cleaner 33 is secured to the engine cover 13. To be more specific, the air cleaner 33 is secured to the engine cover 13 in a hanging position from the top of the engine cover 13 with a bracket not shown in the figures. The air cleaner 33 has a cylindrical shape. The line of the central axis Ax1 for the air cleaner 33 shown in FIG. 3 is nearly horizontal. The line of the central axis Ax1 for the air cleaner 33 is inclined in the longitudinal direction of the bulldozer 1. Additionally, the line of the central axis Ax1 for the air cleaner 33 is inclined in the direction of the width direction of the bulldozer 1. To be more specific, the line of the central axis Ax1 for the air cleaner 33 extends at an incline to the rear right. The air cleaner 33 includes an inlet (not shown in the figures) and an outlet 331. The inlet is connected to a head part 35 via piping material not shown in the figure. The head part 35 protrudes upwards from the top surface of the engine cover 13. The outlet 331 is installed on the side of the air cleaner 33. The outlet 331 is positioned higher than the aforementioned supercharger 28.

The duct 34 is connected to the air cleaner 33 and the engine 5. The duet 34 extends down from the outlet 331 of the air cleaner 33 and has a shape bent towards the supercharger 28. As shown in FIG. 2, the duct 34 includes a first connector 36, a second connector 37 and a shock absorbing part 38. The first connector 36 is connected to the engine 5. To be more specific, the first connector 36 is connected to the supercharger 28. The second connector 37 is connected to the air cleaner 33. The second connector 37 is connected to the outlet 331 of the air cleaner 33. The shock absorbing part 38 is positioned between the first connector 36 and the second connector 37 in the duct 34. The shock absorbing part 38 has a bellows shape.

The vehicle body 3 includes an exhaust emission control device, 41 and a front mounting bracket 50. The exhaust emission control device 41 is a device that purifies the exhaust from the engine 5. The exhaust emission control device 41 is for example, a diesel particulate filter. Alternatively, the exhaust emission control device 41 can also be another device such as that for SCR (Selective Catalytic Reduction). As shown in FIGS. 3 and 4, the exhaust emission control device 41 includes a main body pipe part 42, a first connecting pipe part 43 and a second connecting pipe part 44. The main body pipe part 42 houses parts such as a filter or a catalytic agent, and the exhaust from the engine 5 is purified inside the main body pipe part 42. The first connecting pipe part 43 and the second connecting pipe part 44 are connected to the main body pipe part 42. The first connecting pipe part 43 is situated to protrude upwards from the main body pipe part 42. The first connecting pipe part 43 is connected to one of the sides of the main body pipe part 42. The first connecting pipe part 43 is connected to the previously mentioned supercharger 28 via the first piping material 45. The second connecting pipe part 44 is situated to protrude upwards from the main body pipe part 42. The second connecting pipe part 44 is connected to the other side of the main body pipe part 42. The second connecting pipe part 44 is connected to the exhaust pipe 47 via the second piping material 46. As shown in FIG. 2, the exhaust pipe 47 is situated to protrude upwards from the engine cover 13.

In the plane view of the bulldozer 1, the main body pipe part 42 of the exhaust emission control device 41 is situated in a position in the farthest front inside the engine cover 13 in front of the engine 5. At least a portion of the main body pipe part 42 is situated to overlap with the engine 5 in the front view of the bulldozer 1. This positioning is possible because the cooling device 14 is situated behind the cab 12 instead of inside the engine cover 13. The main body pipe part 42 is situated between the front surface of the engine 5 and the front surface of the engine cover 13. The main body pipe part 42 has a cylindrical shape. The longer direction of the main body pipe part 42 is parallel to the widthwise direction of the bulldozer 1. Additionally, the line of the central axis Ax2 for the main body pipe part 42 is parallel to the widthwise direction of the bulldozer 1. The widthwise dimensions of the main body pipe part 42 are larger than the widthwise dimensions of the engine 5. The main body pipe part 42 is situated lower than the top surface of the cylinder head cover 26. The main body pipe part 42 is situated higher than the bottom surface of the oil pan 23.

The exhaust emission control device 41 is mounted on the front mounting bracket 50, and is supported by the engine 5 via, the front mounting bracket 50. Specifically, the exhaust emission control device 41 includes a pipe bracket 48 mounted on the main body pipe part 42. The pipe bracket 48 is mounted to the front mounting bracket 50, and the main body pipe part 42 is supported by the engine 5 via the pipe bracket 48 and the front mounting bracket 50.

Figure 5:
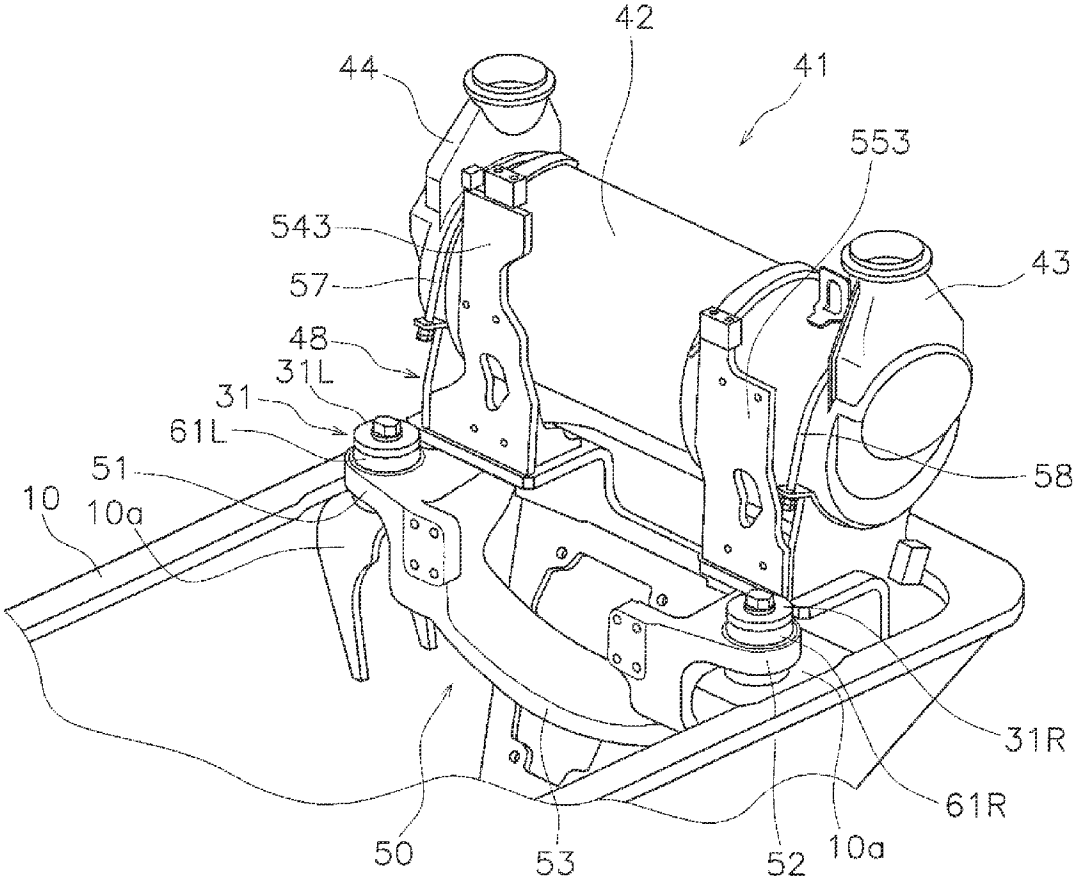
FIG. 5 is a perspective view showing an exhaust emission control device and a front mounting bracket inside the engine cover.
Figure 6:
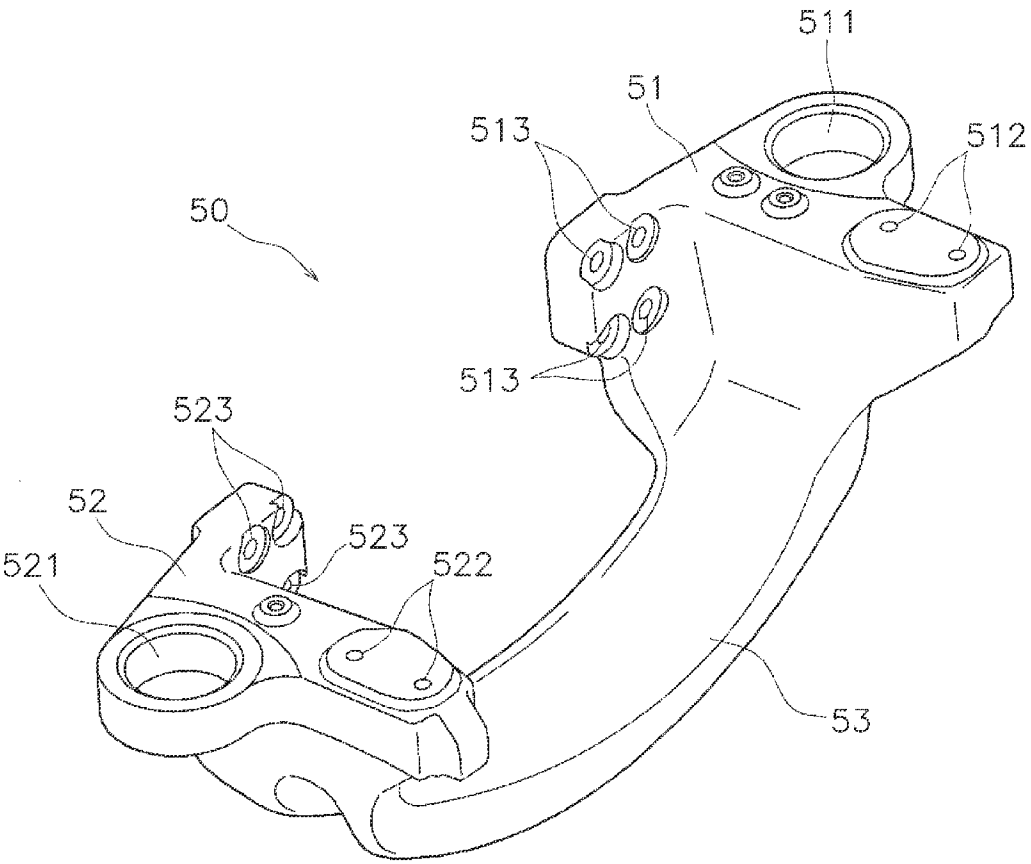
FIG. 6 is a perspective view of the front mounting bracket.
Figure 7:
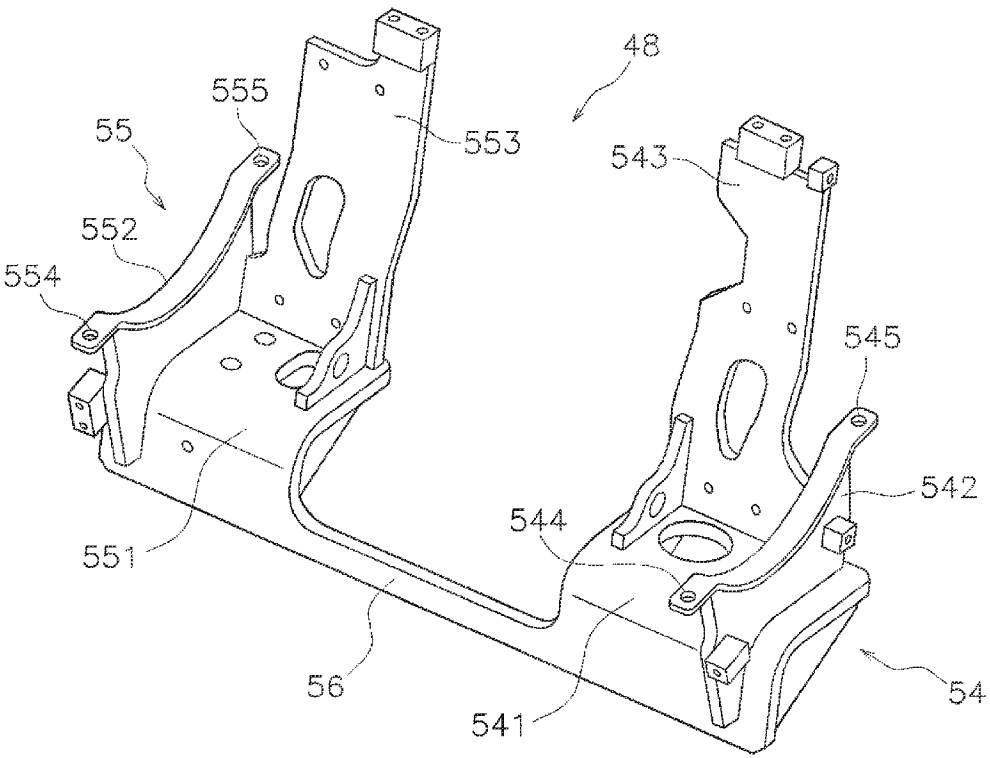
FIG. 7 is a perspective view of a pipe bracket.

FIG. 5 is a perspective view showing the exhaust emission control device 41 and the front mounting bracket 50. FIG. 6 is a perspective view of the front mounting bracket 50. FIG. 7 is a perspective view of the pipe bracket 48. As shown in FIG. 5, the front mounting bracket 50 is mounted on the body frame 10 via the front mounting part 31. The front mounting bracket 50 is mounted on the engine 5. Additionally, the engine 5 is supported by the front mounting part 31 via the front mounting bracket 50. The front mounting part 31 includes a left front mounting part 31L (left front mounting section) and a right front mounting part 31R (right front mounting section). The left front mounting part 31L and the right front mounting part 31R are positioned separated each other in the widthwise direction of the bulldozer 1.

As shown in FIG. 6, the front mounting bracket 50 includes a left bracket part 51, a right bracket part 52 and a connector 53. The left front mounting part 31L is mounted on the left bracket part 51. To be more specific, the left bracket part 51 includes a left mounting opening 511. The left mounting opening 511 penetrates through the left bracket part 51 in the vertical direction. The left front mounting part 31L is inserted into the left mounting opening 511. The right front mounting part 31R is mounted on the right bracket part 52. To be more specific, the right bracket part 52 includes a right mounting opening 521. The right mounting opening 521 penetrates through the right bracket part 52 in the vertical direction. The right front mounting part 311R is inserted into the right mounting opening 521.

The left bracket part 51 includes a left pipe part mounting opening 512. The left pipe part mounting opening 512 is disposed on the top surface of the left bracket part 51. The left pipe part mounting opening 512 is a screw hole where a screw not shown in the figures is tightened. The pipe bracket 48 is mounted to the left bracket part 51 by screwing a screw into the left pipe part mounting opening 512. The right bracket part 52 includes a right pipe part mounting opening 522. The right pipe part mounting opening 522 is disposed on the top surface of the right bracket part 52. The right pipe part mounting opening 522 is a screw hole where a screw not shown in the figures is tightened. The pipe bracket 48 is mounted to the right bracket part 52 by screwing a screw into the right pipe part mounting opening 522.

The left bracket part 51 includes a left engine mounting opening 513. The left engine mounting opening 513 penetrates the left bracket part 51 in the longitudinal direction of the bulldozer 1. The left bracket part 51 is mounted to the front surface of the engine 5 with the bolt in the left engine mounting opening 513. The right bracket part 52 includes a right engine mounting opening 523. The right engine mounting opening 523 penetrates the right bracket part 52 in the longitudinal direction of the bulldozer 1. The right bracket part 52 is mounted to the front surface of the engine 5 with the bolt in the right engine mounting opening 523.

The connector 53 connects the left bracket part 51 and the right bracket part 52. The connector 53 has a shape with an indentation in the downwards direction. As shown in the front view of the bulldozer 1 in FIG. 4, the connector 53 is situated under the crank shaft 21. Additionally, in the front view of the bulldozer 1, the connector 53 is situated under the cam pulley 27. As shown in FIG. 2, the connector 53 includes a recess 531 extending in the widthwise direction of the bulldozer 1. The recess 531 extends upwards from the bottom surface of the connector 53.

The pipe bracket 48 is secured to the front mounting bracket 50. The pipe bracket 48 is disposed on the front mounting bracket 50. The pipe bracket 48 is situated forward of the front mounting part 31. As shown in FIG. 7, the pipe bracket 48 includes a left pipe bracket 54, the right pipe bracket 55 and the pipe bracket connector 56.

The left pipe bracket 54 includes a left base 541, the left support part 542, and the left wall part 543. The left support part 542 is installed to protrude upwards from the left base 541. The top surface of the left support part 542 has a shape that bends downwards. The main body pipe part 42 is disposed on the left support part 542. The left support part 542 supports the main body pipe part 42. There are openings 544 and 545 at the front and back of the left support part 542. The left wire stationary material 57 (refer to FIG. 5) passes through these openings 544 and 545. The left stationary material 57 is bent into the shape of the letter U. The left stationary material 57 is secured to the left support part 542 to affix the main body pipe part 42 to the left pipe bracket 54. The left wall part 543 extends upwards from the left base 541. The left wall part 543 has a plate shape. The left wall part 543 is situated behind the main body pipe part 42. The right pipe bracket 55 includes the right base 551, the right support part 552 and the right wall part 553. The right pipe bracket 55 has a near symmetrical shape with the left pipe bracket 54. Additionally, the right base 551, right support part 552 and right wall part 553 are nearly symmetrically shaped with the left base 541, the left support part 542, and the left wall part 543. There are openings 554 and 555 at the front and back of the right support part 552. The right wire stationary material 58 (refer to FIG. 5) passes through these openings 554 and 555. The right stationary material 58 is bent into the shape of the letter U. The right stationary material 58 is secured to the right support part 552 to affix the main body pipe part 42 to the right pipe bracket 55.

The pipe bracket connector 56 connects the left pipe bracket 54 and the right pipe bracket 55. To be more specific, the pipe bracket connector 56 connects the left base 541 and the right base 551. As shown in the front view of the bulldozer 1 in FIG. 4, the pipe bracket connector 56 is situated higher than the connector 53 of the front mounting bracket 50. In the front view of the bulldozer 1, the pipe bracket connector 56 is situated lower than the crank shaft 21. In the front view of the bulldozer 1, the pipe bracket connector 56 is situated lower than the bottom part of the main body pipe part 42. Also, at least a portion of the cam pulley 27 is visible in the front view of the bulldozer 1 between the pipe bracket connector 56 and the bottom part of the main body pipe part 42.

Next is a description of the front mounting part 31 and the rear mounting part 32. The front mounting part 31 is situated lower than the rear mounting part 32. As described earlier, the front mounting part 31 includes the left front mounting part 31L and the right front mounting part 31R. As shown in FIG. 5, the left front mounting part 31L includes a first left elastic part 61L. The right front mounting part 31R includes a first right elastic part 61R. The first left elastic part 61L and the right elastic part 61R are each formed of an elastic material such as rubber. The first left elastic part 61L and the right elastic part 61R each have a cylindrical shape. The front mounting bracket 50 supports the body frame 10 via the first left elastic part 61L and the first right elastic part 61R. Additionally, the engine 5 and the exhaust emission control device 41 are elastically supported by the body frame 10 by the front mounting part 31.

As shown in FIG. 2, the rear mounting part 32 is situated behind and above the front mounting part 31. The rear mounting part 32 is situated higher than the center of gravity G1 of the engine 5. The front mounting part 31 is situated lower than the center of gravity G1 of the engine 5. The center of gravity G1 of the engine 5 is closer to the front mounting part 32 than the front mounting part 31 in the longitudinal direction. At least a portion of the rear mounting part 32 is situated above the flywheel housing 6. The rear mounting part 32 is situated higher than the hydraulic pump 7. The rear mounting part 32 is positioned lower than the top surface of the cylinder head cover 26. The rear mounting part 32 is positioned below the cab 12. For the description of this embodiment, the center of each mounting part in the vertical direction is used as the standard for the vertical position of the front mounting part 31 and the rear mounting part 32. Alternatively, the position of the seat surface of each mounting part can be used as the standard.

Figure 8:
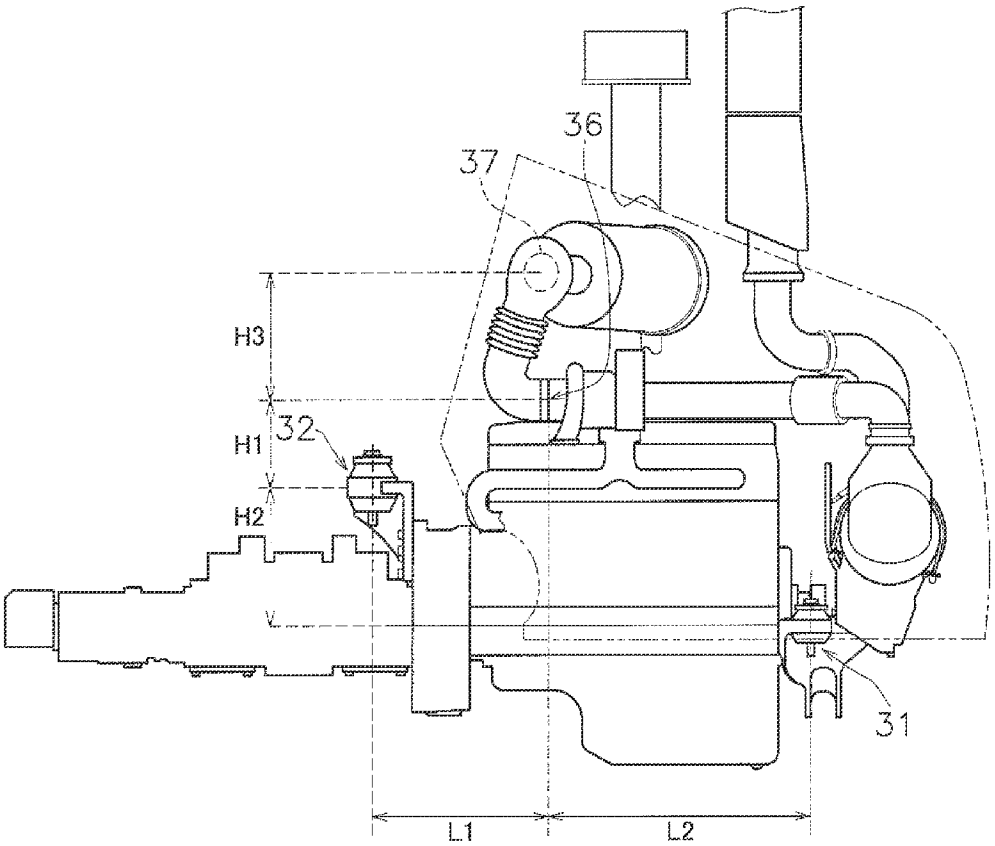
FIG. 8 is a side view showing the configuration inside the engine cover.

As shown in FIG. 8, the vertical height H1 between the rear mounting part 32 and the first connector 36 is less than the height H2 between the rear mounting part 32 and the front mounting part 31. For the vertical direction, the height H1 between the rear mounting part 32 and the first connector 36 is less than the height H3 between the first connector 36 and the second connector 37. For this embodiment, the center of each connector in the vertical direction is used as the standard for the vertical position of the first connector 36 and the second connector 37.

Figure 9:
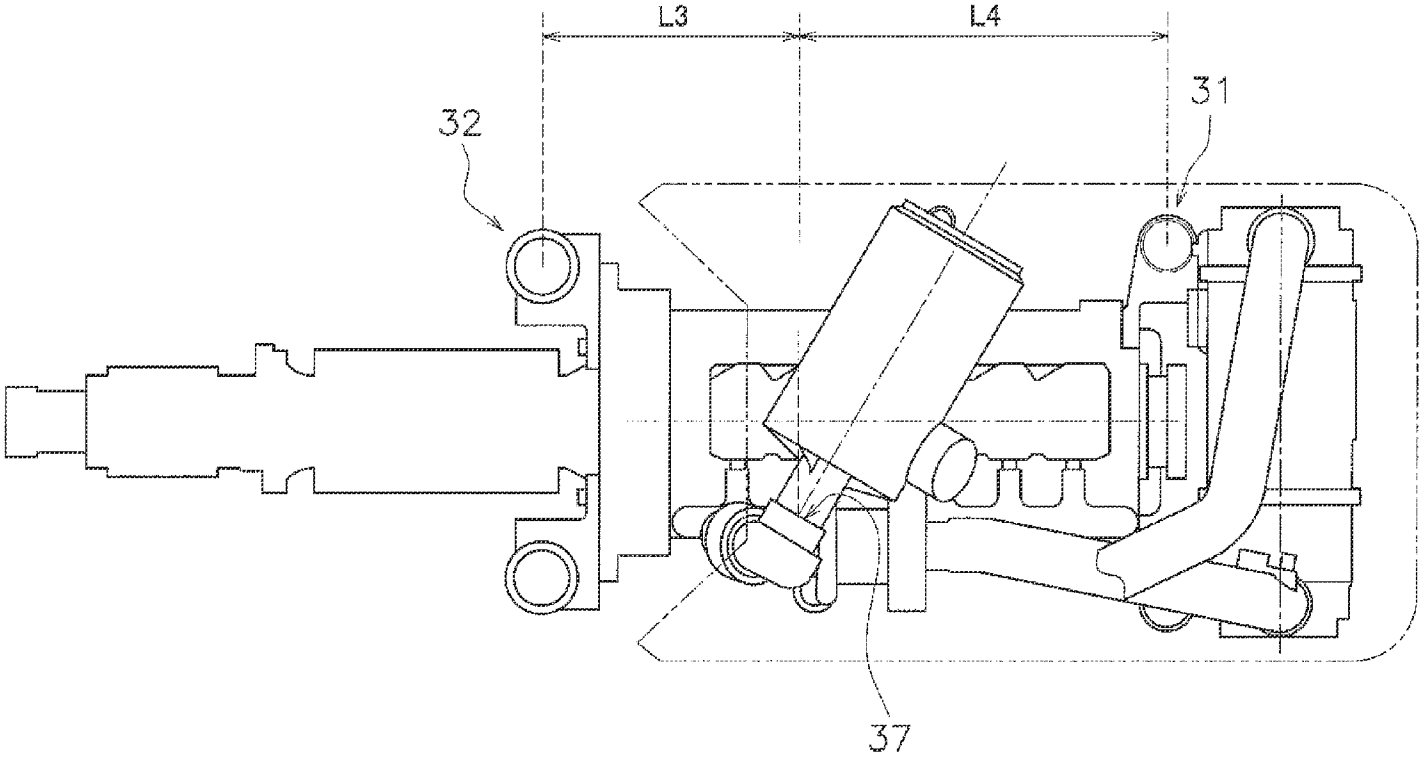
FIG. 9 is a plane view showing the configuration inside the engine cover.

In the longitudinal direction of the bulldozer 1, the length L1 between the first connector 36 and the rear mounting part 32 is less than the length L2 between the first connector 36 and the front mounting part 31. As shown in FIG. 9, in the longitudinal direction, the length L3 between the second connector 37 and the rear mounting part 32 is less than the length L4 between the second connector 37 and the front mounting part 31. For the description of this embodiment, the standard for the longitudinal direction position of the front mounting part 31 and the rear mounting part 32 is centered in the longitudinal direction of each connector. The standard for the longitudinal direction position of the first connector 36 and the second connector 37 is centered in the longitudinal direction of each connector As shown in FIG. 3, the rear mounting part 32 includes the left rear mounting part 32L and the right rear mounting part 32R. The left rear mounting part 32L and the right rear mounting part 32R are positioned separated each other in the widthwise direction of the bulldozer 1. The left rear mounting part 32L includes a second left elastic part 62L. The right rear mounting part 32R includes a second right elastic part 62R. The second left elastic part 62L and the second right elastic part 62R are each formed of an elastic material such as rubber. The second left elastic part 62L and the second right elastic part 62R each have a cylindrical shape. The diameters of the second left elastic part 62L and the second right elastic part 62R are both greater than the diameters of the first left elastic part 61L and the first right elastic part 61R. The engine 5 is elastically supported by the body frame 10 at the rear mounting part 32 with the second left elastic part 62L and the second right elastic part 62R.

As shown in FIG. 2, the rear mounting part 32 is mounted to the engine 5 with the rear mounting bracket 63. The rear mounting bracket 63 is mounted to the flywheel housing 6. The rear mounting bracket 63 extends upwards from the flywheel housing 6. To be more specific, as shown in FIG. 3, the rear mounting bracket 63 includes a left rear bracket part 63L and a right rear bracket part 63R. The left rear bracket part 63L and the right rear bracket part 63R are separated members. The left rear bracket part 63L and the right rear bracket part 63R are positioned apart from each other in the widthwise direction of the bulldozer 1. In the plane view of the bulldozer 1, the previously mentioned hydraulic pump 7 is situated between the left rear bracket part 63L and the right rear bracket part 63R. The left rear bracket part 63L and the right rear bracket part 63R are both mounted to the back surface of the flywheel housing 6.

The bulldozer 1 relating to this embodiment has the following features.

The main body pipe part 42 of the exhaust emission control device 41 is situated in front of the engine 5, and at least a portion of the main body pipe part 42 is situated to overlap with the engine 5 in the front view of the bulldozer 1. Compared to when the main body pipe part 42 is situated above the engine 5, the distance between the main body pipe part 42 and the front mounting part 31 is small. Therefore, the amount of vibration to the engine 5 for the main body pipe part 42 can be reduced. As a result, the load on the exhaust emission control device 41 can be reduced. Furthermore, since the position on top surface of the engine cover 13 is lower, the visibility from the cab 12 can be improved.

The exhaust emission control device 41 is supported by the engine 5. Therefore, the amount of vibration between the engine 5 and the exhaust emission control device 41 can be reduced. As a result, the load on the exhaust emission control device 41 can be reduced.

The exhaust emission control device 41 is supported by the engine 5 via the front mounting bracket 50. Also, the engine 5 is supported by the front mounting part 31 via the front mounting bracket 50. Additionally, the front mounting bracket 50 serves the same function as a bracket function for mounting the exhaust emission control device 41 and a mounting bracket for the engine 5. As a result, it is possible to avoid increase the number of components and enables the exhaust emission control device 41 to be situated in front of the engine 5.

The front mounting bracket 50 has a configuration connecting the left bracket part 51 and the right bracket part 52 with the connector 53. Thus, the rigidity of the front mounting bracket 50 is enhanced. Accordingly, the front mounting bracket 50 can firmly support the heavy exhaust emission control device 41.

The connector 53 of the front mounting bracket 50 has a shape with an indentation in the downwards direction. In the front view of the bulldozer 1, the connector 53 is situated under the crank shaft 21. So, if a foreign object such as a leaf gets into the engine cover 13 from outside, the foreign object is prevented from settling between the front mounting bracket 50 and the engine 5. Also, the front mounting bracket 50 prevents interference with the cam pulley 27.

The front mounting part 31 is situated lower than the rear mounting part 32. If this position is adopted for this front mounting part 31 and the exhaust emission control device 41 is situated above the engine 5, the distance between the exhaust emission control device 41 and front mounting part 31 can especially be increased. However, as indicated above, the main body pipe part 42 of the exhaust emission control device 41 in the bulldozer 1 in this embodiment is situated in front of the engine 5. Therefore, even if the front mounting part 31 is positioned below the rear mounting part 32, the distance between the main body pipe part 42 and the front mounting part 31 can be reduced.

The main body pipe part 42 is supported by the front mounting bracket 50 via the pipe bracket 48. As a result, the main body pipe part 42 can be easily situated in the desired location.

The lengthwise direction of the main body pipe part 42 is parallel to the widthwise direction of the bulldozer 1. As a result, the main body pipe part 42 snugly situated in front of the engine 5.

The main body pipe part 42 is situated below the top surface of the cylinder head cover 26. Thus, the distance between the main body pipe part 42 and the front mounting part 31 can be reduced.

The main body pipe part 42 is situated higher than the bottom surface of the oil pan 23. From the perspective of reducing the distance between the main body pipe part 42 and the front mounting part 31, it is preferred that the position of the main body pipe part 42 be as low as possible. However, on the other hand, the distance between the main body pipe part 42 and the supercharger 28, or the distance between the main body pipe part 42 and the exhaust pipe 47 is lengthened. In this case, the first piping material 45 connecting the main body pipe part 42 and the supercharger 28 or the second piping material 46 connecting the main body pipe part 42 and the exhaust pipe 47 is lengthened. With the bulldozer 1 in this embodiment, the main body pipe part 42 is situated higher than the bottom surface of the oil pan 23 so it is possible to prevent lengthening the first piping material 45 or the second piping material 46.

The first connecting pipe part 43 is situated to protrude upwards from the main body pipe part 42. Thus, the first piping material 45 can be positioned snugly. Additionally, the second connecting pipe part 44 is situated to protrude upwards from the main body pipe part 42. Thus, the second piping material 46 can be positioned snugly. Furthermore, since the first connecting pipe part 43 and the second connecting pipe part 44 are installed to protrude upwards from the main body pipe part 42, there is no need for pipes in the line along the central axis Ax2, and the exhaust emission control device 41 can be positioned completely in the widthwise direction of the bulldozer 1 inside the engine cover 13. Therefore, the exhaust emission control device 41 can be positioned snugly in the bulldozer 1, providing the needed space for purification.

The air cleaner 33 is situated above the engine 5. If both the air cleaner 33 and the exhaust emission control device 41 are situated above the engine 5, it will be more difficult to keep the top surface of the engine cover 13 low. However, as mentioned above, with the bulldozer 1 in this embodiment, the main body pipe part 42 of the exhaust emission control device 41 is situated in front of the engine 5 so it is possible to keep the top surface of the engine cover 13 low.

The top surface of the engine cover 13 is inclined towards the front and downward. Therefore, visibility toward the front from the cab 12 improves. On the other hand, with the shape of this engine cover 13, there is less space at the top of the engine 5 inside the engine cover 13. To position the exhaust emission control device 41 above the engine 5, the position on the engine cover 13 must be raised. However, as indicated above, with the bulldozer 1 in this embodiment, the main body pipe part 42 of the exhaust emission control device 41 is situated in front of the engine 5 so the top surface of the engine cover 13 can be positioned lower.

The above describes an embodiment of the present invention but the present invention is not limited to the aforementioned embodiment, and various modifications are possible without departing from the scope and the spirit of the invention.

In the abovementioned embodiment, the positioning of the front mounting part 31, the rear mounting part 32, the first connector 36 and the second connector 37 in designated areas are used as the standards but other areas can be used as the standards for designating positions for each of these parts.

In the abovementioned embodiment, all of the main body pipe part 42 is situated lower than the top surface of the engine 5 but a portion of the main body pipe part 42 can be situated lower than the top surface of the engine 5. In other words, a portion of the main body pipe part 42 can be situated higher than the engine 5.

The shape of the exhaust emission control device 41 is not limited to the shapes mentioned above. For example, the first connecting pipe part 43 and the second connecting pipe part 44 can protrude in a direction other than upwards. Alternatively, the main body pipe part 42 can be situated inclined relative to horizontal.

The shape of the front mounting bracket 50 is not limited to the shapes mentioned above, and suitable modifications may be made. The shape of the pipe bracket 48 is not limited to the shapes mentioned above and suitable modifications may be made.

The invention claimed is:

1. A bulldozer comprising:
a cab;
a cooling device situated behind the cab;
an engine cover situated in front of the cab;
an engine situated inside the engine cover, and including a crank shaft extending in a longitudinal direction of the bulldozer; and
an exhaust emission control device including a main body pipe part and a connecting pipe part connected to the main body pipe part to clean exhaust from the engine inside the main body pipe part,
wherein the main body pipe part is situated in front of the engine with at least a portion of the main body pipe part extending across a front of the engine in a front view of the bulldozer.

2. The bulldozer according to claim 1,wherein
the exhaust emission control device is situated in a position furthest to the front in the engine cover, and is supported by the engine.

3. The bulldozer according to claim 1, further comprising
a front mounting part supporting the engine, wherein
the main body pipe part is situated above the front mounting part.

4. The bulldozer according to claim 1, wherein
a lengthwise direction of the main body pipe part is parallel to a widthwise direction of the bulldozer.

5. The bulldozer according to claim 1, wherein
the engine includes a cylinder head cover, and
the main body pipe part is situated below a top surface of the cylinder head cover.

6. The bulldozer according to claim 1, wherein
the engine includes an oil pan, and
the main body pipe part is situated above the bottom of the oil pan.

7. The bulldozer according to claim 1, wherein
the connecting pipe part protrudes upwards from the main body pipe part.

8. The bulldozer according to claim 1, further comprising
an air cleaner situated above the engine.

9. The bulldozer according to claim 1, wherein a top surface of the engine cover is inclined towards the front and downwards.

10. The bulldozer according to claim 3, further comprising:

a rear mounting part situated rearward of the front mounting part, and a mounting bracket mounted to the engine, wherein the engine is supported by the front mounting part via the mounting bracket, the exhaust emission control device is mounted to the mounting bracket, and the exhaust emission control device is supported by the engine via the mounting bracket.

11. The bulldozer according to claim 10, wherein the front mounting part includes a left front mounting section and a right front mounting section positioned separated in a widthwise direction of the bulldozer, the mounting bracket includes:

a left bracket part where the left front mounting section is mounted;

a right bracket part where the right front mounting section is mounted; and a connector connecting the left bracket part and the right bracket part.

12. The bulldozer according to claim 10, wherein the front mounting part is situated below the rear mounting part.

13. The bulldozer according to claim 10, wherein the exhaust emission control device further includes a pipe bracket mounted to the main body pipe part, and the pipe bracket is mounted to the mounting bracket.

14. The bulldozer according to claim 11, wherein the connector has a shape with an indentation in a downwards direction, and the connector is situated under the crank shaft in the front view of the bulldozer.

* * * * *